US005264828A

United States Patent [19]

Meiksin et al.

[11] Patent Number: 5,264,828

[45] Date of Patent: Nov. 23, 1993

[54] PERSONAL SECURITY ALARM SYSTEM

[75] Inventors: Zvi H. Meiksin; Melvin K. Fischman, both of Pittsburgh; Gregory Bertone, Monroeville, all of Pa.

[73] Assignee: ParkSafe, Inc., Pittsburgh, Pa.

[21] Appl. No.: 965,511

[22] Filed: Oct. 23, 1992

Related U.S. Application Data

[63] Continuation of Ser. No. 680,580, Apr. 4, 1991, abandoned.

[51] Int. Cl.[5] ..... G08B 1/08

[52] U.S. Cl. ..... 340/539; 340/531; 340/525

[58] Field of Search ..... 340/539, 531, 506, 518, 340/525, 306, 307, 286.14, 825.06, 825.54

[56] References Cited

U.S. PATENT DOCUMENTS

| | | | |
|---|---|---|---|
| 3,939,460 | 2/1976 | Horn et al. | 340/518 |
| 4,095,211 | 6/1978 | Shaughnessy | 340/539 |
| 4,468,655 | 8/1984 | Iwata | 340/518 |
| 4,611,198 | 9/1986 | Levinson et al. | 340/531 |
| 4,670,739 | 6/1987 | Kelly, Jr. | 340/539 |
| 4,737,758 | 4/1988 | Meiksin et al. | 340/539 |
| 4,857,883 | 8/1989 | Mama | 340/306 |
| 4,951,029 | 8/1990 | Severson | 340/531 |
| 5,070,320 | 12/1991 | Ramono | 340/539 |

OTHER PUBLICATIONS

Hasler Review vol. 14, No. 4, "Hasler Personnel Protection Systems", R. Petersen Dec. 1981, pp. 122-127.

*Primary Examiner*—Donnie L. Crosland
*Attorney, Agent, or Firm*—Dennis M. Flaherty

[57] ABSTRACT

A personal security alarm system which activates audible and visible alarms instantly at the location of an emergency, and simultaneously notifies security personnel of the existence and location of the emergency so that response to the call for help can be immediate. When a person is threatened, the person actuates a hand-held alarm actuator-transmitter by pressing a pushbutton. The signal is received by an area relay receiver which triggers an alarm at the location where the incident is occurring. At the same time the area relay receiver relays the state of emergency to a master computer which identifies the area relay receiver activated by the hand-held alarm actuator-transmitter. The master computer activates an annunciator and displays on a color video screen graphically and in print the floor plan or the site layout where the incident is occurring. A portable device is provided for resetting the portable alarm activator. This resetting device determines whether the portable alarm activator has been activated when the latter is inserted in the former in a predetermined direction, and deactivates the activated portable alarm activator when the latter in inserted in the former in a direction opposite to the predetermined direction.

18 Claims, 7 Drawing Sheets

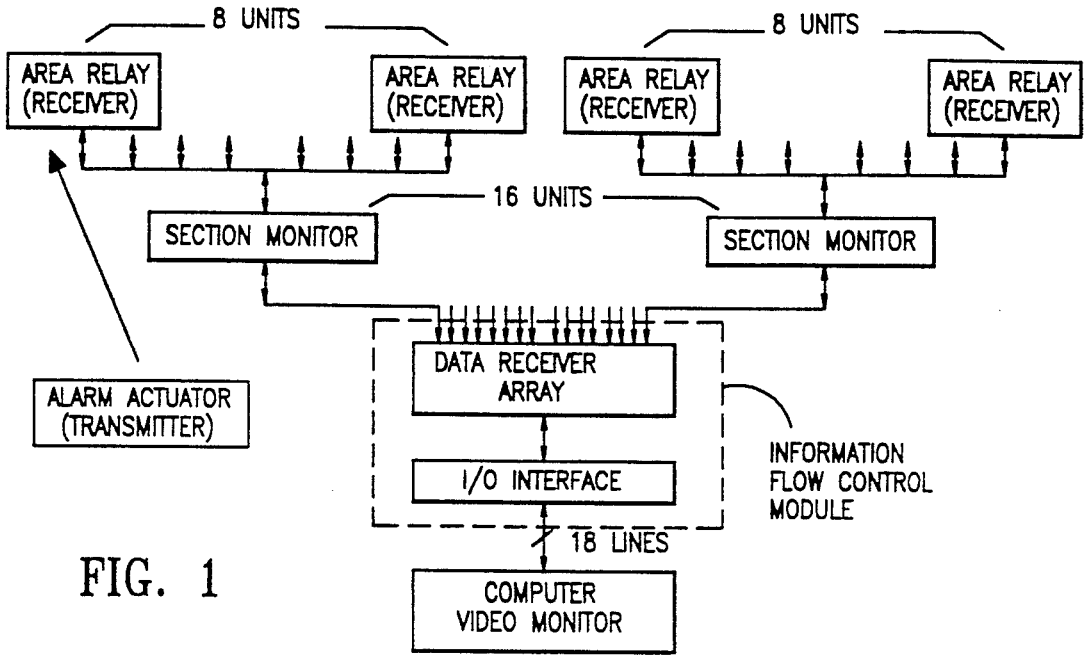
FIG. 1
FIG. 2
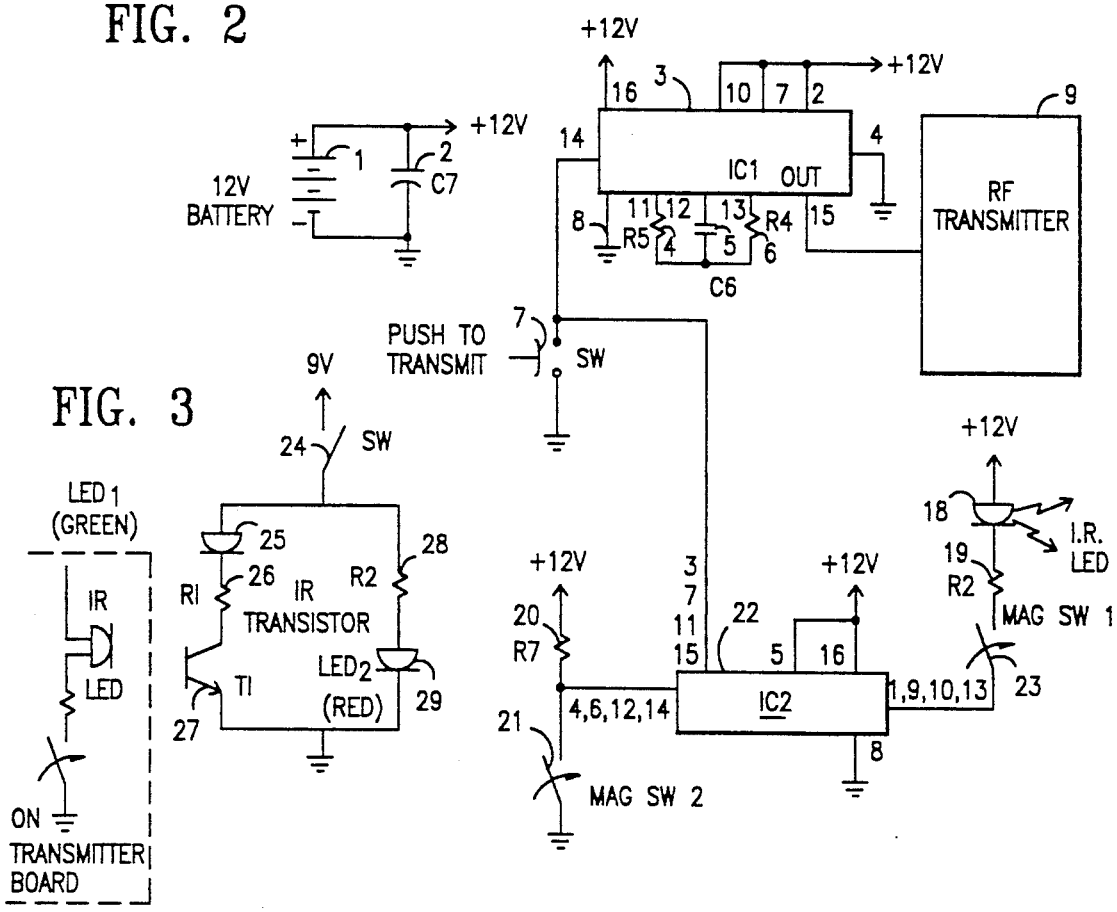
FIG. 3

PERSONAL SECURITY ALARM SYSTEM

This is a continuation of copending application Ser. No. 07/680,580 filed on Apr. 4, 1991, now abandoned.

GENERAL DESCRIPTION

The invention is in the field of security. More specifically, the invention is in the field of *personal* security. In case of an emergency, audible and visible alarms are activated instantly at the emergency location, and simultaneously, the system notifies security personnel that the incident is happening and where it is happening, so that response to the call for help can be immediate.

When a person is threatened, he/she actuates a Hand-Held Alarm Actuator-Transmitter (HHAA) by pressing a push-button (or the activator can be programmed to require pushing button twice within a certain time interval, or pressing and pushing button upwards, or any other method can be employed to reduce chance of accidental triggering).

The signal is received by an Area Relay Receiver (AR) which triggers an alarm or alarms (horn and strobe light or flood light, etc.) at the location where the incident is taking place, and at the same time the AR relays the state of emergency (i.e. call for help) to a Section Monitor (SM), which in turn communicates the identity of the activated AR to a Data Receiver Card (DR) in an Information Flow Control Module (IFCM), thus identifying the location of the emergency. This information is entered via an I/O Interface Card (IO) in the IFCM to a Master Computer (MC). The MC activates an annunciator and displays on a color video screen graphically and in print the floor plan or the site layout where the incident is taking place, and identifies the location and other pertinent information, Help is dispatched immediately to where it is needed.

Part or all of the communication can be done wireless, or by modulation onto power lines using known techniques, or by hard wiring.

Many options for, and variations of, the system are possible. For example, each HHAA may have an identification means, such as a bar-code for example, which may be of the infrared type, which can be used to identify the unit with a suitable Code reader. Each HHAA may transmit a unique code, when activated, which is transferred to the computer via the path described above. The system may include a device that sensed the signal transmitted by the HHAA and indicates an increased signal as the device comes closer to the HHAA which can be used to locate the HHAA. Several different means can be used to turn the alarm off either locally or from the computer.

A few of the many possibilities will be identified by describing a preferred arrangement with reference to the drawings, wherein:

FIG. 1 is a signal flow chart for a personal security system in accordance with the preferred embodiment of the invention.

FIG. 2 is a logic diagram of the hand-held alarm activator in accordance with the preferred embodiment of the invention.

FIG. 3 is a logic diagram of the activated transmitter identifier and resetter in accordance with the preferred embodiment of the invention.

Figure 4:
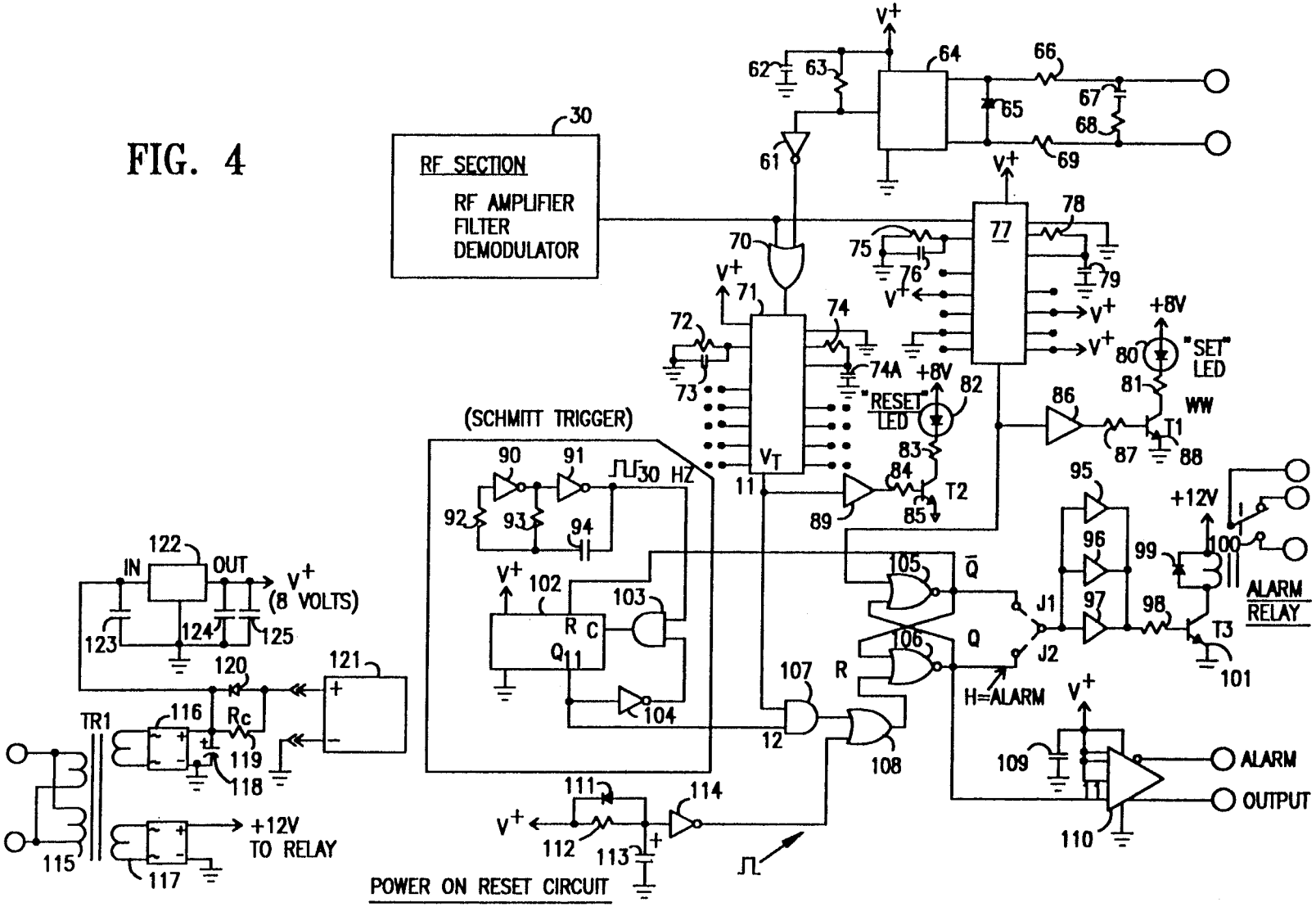
FIG. 4 is a logic diagram of the area relay in accordance with the preferred embodiment of the invention.

The signal flow, as was described above, is shown in the Flow Chart given in FIG. 1. Each SM is connected to up to eight ARs. Up to sixteen SMs are connected to Data Receiver cards (DR) in a IFCM. The DRs are connected through an IO in the IFCm to a MC via a I/O interface, such as a Metrabyte Model VMEPIO-24 in the MC. With such an arrangement up to 128 ARs can be monitored. To monitor a larger number of ARs, a second IFCm is added and connected to the I/O Interface. The structure is modular so that the system can be expanded indefinitely to any number of ARs.

The guard, who response to the emergency call, carries with him a transmitter which can be used to reset an activated AR which removes the emergency call signal and also resets the alarm horn and alarm light. But said reset transmitter is able to perform its functional only after the HHAA has been reset. The HHAA can be reset only by means of a second device carried by the guard. The HHAA becomes reset upon its insertion, in a specified direction, into said second device which couples to it magnetically. When the HHAA is inserted into said second device in the opposite direction, prior to it being reset, the said second device indicates whether or not the HHAA had been activated.

An activated AR can also be reset by means of the MC by sending a confined signal through the IO and DR (in the IFCM), and through the SM to the AR.

The information in the MC can be used for record keeping, statistical analyses, etc., it can be printed out, and it can also be interfaced with a mainframe computer.

SYSTEM COMPONENTS

1. Hand-Held Alarm Activator (HHAA)—FIGME 2

The circuit diagram of the HHAA is shown in FIG. 2. The HHAA contains an RF transmitter 9 of frequency of, for example, 320 MHz.

The RF signal is modulated by means of a Pulse Encoder 3 with associated Resistors 4 and 6 and Capacitor 5. To initiate transmission, switch 7 must be momentarily closed. Once activated, the transmitter latches by means of RS Latch 22. When latched, terminals 1, 9, 10, and 13 of Latch 22 have a HIGH output. This prevents LED 18 from being turned ON when magnetic switch 23 is closed. When magnetic switch 21 is closed, terminal 3, 7, 11 and 15 of RS Latch 22 go HIGH and the transmitter becomes deactivated. At the same time, terminals 1, 9, 10, and 13 of Latch 22 go LOW, and when Magnetic Switch 23 is closed, Infrared LED 18 is turned ON.

The HHAA is powered with Battery 1 shunted with Capacitor 2.

2. Activated-Transmitter Identifier and Resetter (ATIR)—FIG. 3

When the HHAA is inserted Head-In into the ATIR, Switch 24 closes and LED 29 lights. If Infrared LED 18 in the HHAA is not ON, LED 25 in the ATIR does not light. If Infrared LED 18 in the HHAA is ON, transistor 27 in the ATIR turns ON and LED 25 lights.

3. Area Relay—Receiver (AR)—FIG. 4

The Area Relay (AR) consists of an RF section, decoding circuits, power supply, relay, and Auxiliary Circuitries.

The RF section consists of an RF receiver 30, amplifier, filter and demodulator. The signal is decoded by Decoder 77 and associated resistors 75 and 78 and Capacitors 76 and 79. The output of decoder 77, buffered by Buffer 86, activates "Set" LED 80 by turning ON Transistor 88 with associated Resistors 81 and 87. The output from Decoder 77 also activates an Alarm Relay via a Flip-Flop composed of NOR gates 105 and 106, Jumper J1 or J2, Buffers 95-97, Transistor 101 and associated Resistor 98 and Diode 99. The output Q-bar from said Flip-Flop also activates Reset Enable Delay Timer 102 which prevents resetting the relay for a predetermined time period. The output Q from said Flip-Flop sends an alarm signal via Line Driver 110 and associated Capacitor 109 to SM. The delay circuit consists of Timer 102, Inverter 104, and AND gate 103. Timer 102 receives the clock pulse from an oscillator composed of Inverters 90 and 91, Resistors 92 and 93 and Capacitor 94. The time delay is adjusted by Capacitor 94 and Resistor 93.

The alarm can be activated in two separate ways: a reset signal can be received (1) through the RF section, or (2) through reset input terminals. When received through the RF section, the RF signal is filtered, demodulated and amplified by op amps 55 and 59, Resistors 50, 51, 53, 56 and 57, and Capacitors 52, 54, 54A, 58 and 60, and it is entered through NOR gate 70 into Decoder 71. Decoder 71, in conjunction with resistors 72 and 74 and Capacitors 73 and 74A, decodes the signal and activates "Reset" LED 82 via Buffer 89, Transistor 85 and Resistors 83 and 84. The output from terminal 11 of Decoder 71 also resets Alarm Relay 100 via AND gate 107, NOR gate 108 and the Flip-Flop composed of NOR gates 105 and 106. NAND gate 107 passes the reset signal only when a HIGH signal coming from Reset Enable Delay 102 is present at terminal 12 of AND gate 107.

The second means to reset Alarm Relay 100 consists of applying a reset code into Decoder 71 coming from the reset code input terminals and applied through Optical Coupler 64, and associated Diode 65, Resistors 63, 65, 66 and 69 and Capacitors 62 and 67, and through Inverter 61 and NOR gate 70.

When power is first turned ON, a Reset pulse is sent through Inverter 114 and associated Diode 111, Resistor 112 and Capacitor 113, and through NOR gate 108 to the RESET terminal of the Flip-Flop composed of Inverters 105 and 106.

The AR is powered through Power Transformer 115, Full-Wave Rectifier 116 and associated Capacitor 118 and Voltage Regulator 122 with associated Capacitors 123-125. A Battery Pack 121 is included which is being continuously charged through Resistor 119, and which automatically powers the AR through Diode 120 when the power supplied through Transformer 115 fails.

Figure 5:
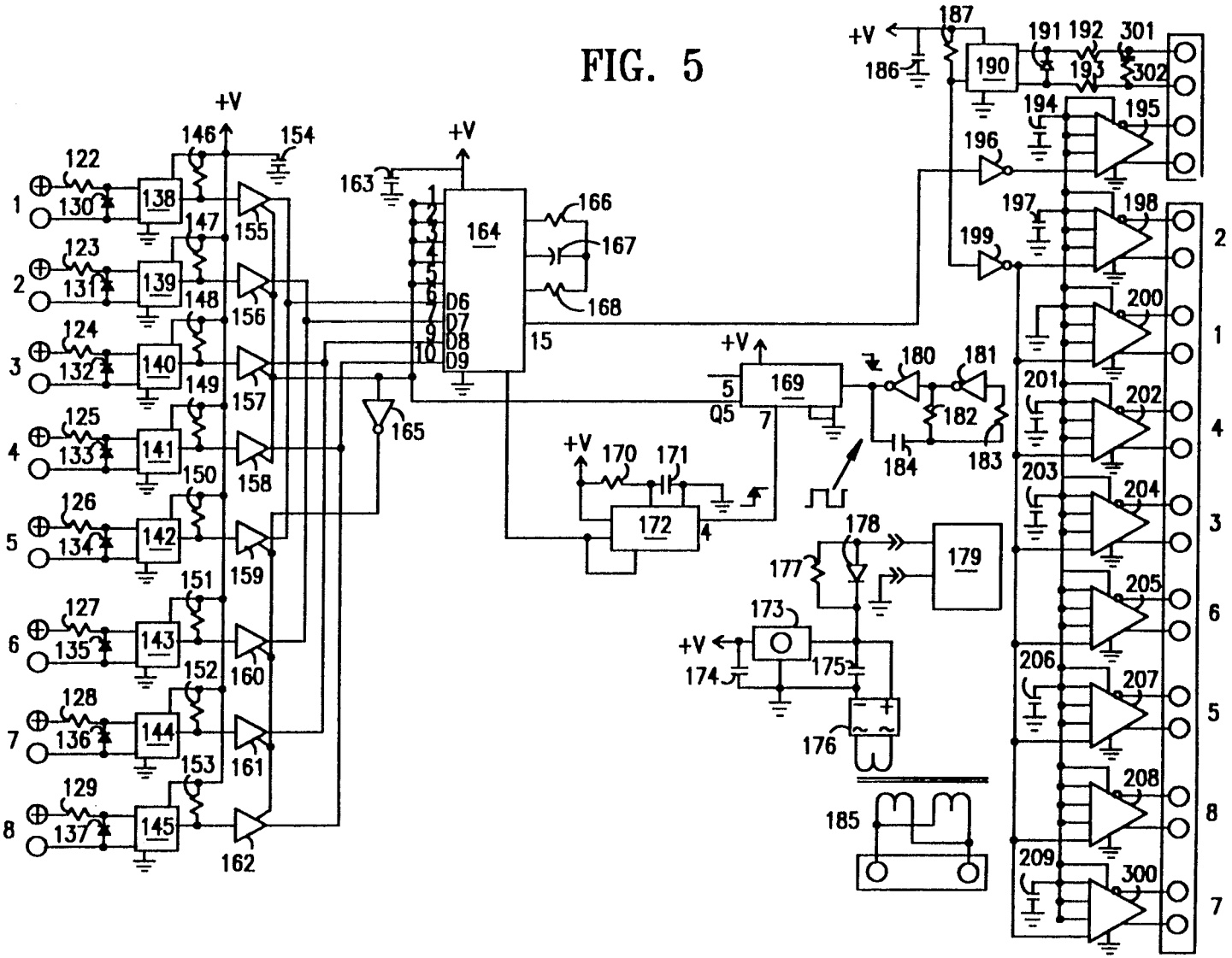
FIG. 5 is a logic diagram of the section monitor in according with the preferred embodiment of the invention.

4. Section Monitor (SM)—FIG. 5

The Section Monitor (SM) receives signals from eight ARs and transmits the state of these ARs to the Data Receiver (DR)in the IFCM.

The AR relays its state to the SM via Optical Coupler 138 and associated Resistors 122 and 146 and Diode 130. Capacitor 154 is a power supply bypass capacitor. When the AR is not in a state of alarm, it provides a logic "1" (for example, 5V). When it is in a state of alarm, it provides a logic "0" (for example, 0 volts)—this assures "Fail Safe" operation. The output from Opto-Coupler 138 is connected to tristate Buffer 155. When the buffer is enabled as controlled by output Q5 of binary Counter 169, the output from Opto-Coupler 138 is transferred through Buffer 155 to the input terminal D6 of Encoder 164. In a like manner the states of three additional ARs are transferred to inputs D7, D8, and D9 through the corresponding Opto-Couplers 139-141 and tristate Buffers 156-158 and associated Resistors 123-125 and 147-149 and Diodes 131-133.

When tristate Buffers 155-158 are enabled, tristate Buffers 159-162 are disabled, because their enabling signal also comes from terminals Q5 of binary Counter 169, but it is connected to the Enable terminals of tristate Buffers 159-162 through Inverter 165. Similarly, when Buffers 159-162 are enabled (and Buffers 155-158 are disabled), four additional ARs, in a like manner, communicate their respective states to Encoder 164 via components 126-129, 134-137, 142-145, 150-153, and 159-162, by entering the data, respectively, into terminals 6-10 of Encoder 164. The address lines, terminals 1-5, of Encoder 164 are toggled high and low by a signal from terminal 5 of binary Counter 169. Therefore one set of Data from four ARs, out of a total of eight ARs which are connected to the SM, is entered at one address, 1111, of Encoder 164 and the other set of Data from the remaining set of four ARs is entered at address 0000. The state of alarm of the eight ARs is transferred to the IFCM serially from terminal 15 of Encoder 164 through Inverter 196 and Line Driver 195 with associated capacitor 194. The Data from Encoder 164 is transmitted four bits at a time (first the lower 4 bits, then the upper 4 bits) as controlled by the signal from terminal 14 of Monostable Multivibrator 172 and associated Resistor 170 and Capacitor 171. Multivibrator 172 is controlled by a signal from terminal 7 of Counter 169, while the output from terminal 5 of Counter 169 controls the address of the transmitted data from Encoder 164. The clock signal for Counter 169 is generated by Inverters 180 and 181 in conjunction with Resistors 182 and 183 and Capacitor 184.

The eight ARs can be reset by a signal that comes from the IFCM and is transmitted to the ARs through the SM. The signal from the IFCM enters the SM through Opto-Coupler 190 with the associated Resistors 187, 192, 193, and 302, and Capacitors 186 and 302, and Diode 191, and is transmitted to the ARs through Inverter 199 and Line Driver 198 with associated Capacitor 197 and Line Drivers 200, 202, 204, 205, 207, and 300, and associated Capacitors 201, 203, 206, and 209. Each Line Driver output connects to one AR.

The SM is powered through Transformer 185, Full-Wave Rectifier 176 and Voltage Regulator 173 with associated Capacitors 174 and 175. Battery Pack 179 is charged continuously through Resistor 177, and in case of power failure, supplies power through Diode 178.

5. Data Receiver (DR)—FIG. 6—(inside IFCMI

Data Receiver (DR) receives information from SM and transfers it to the 1/0 Interface (IO), and it receives data from the Master Computer (MC) through 10 and transfers it to the SM.

The state of alarm (logic "1" means no alarm; logic "0" means alarm) comes from the SM and enters the DR through Optical Coupler 308 with associated Resistors 304–306, and 309, Capacitors 303 and 310 and Diode 307. It is inverted and entered either into Decoder 312 with associated Resistors 312 and 314 and Capacitors 313 and 315, if the received address matches that of the High Order bits, or it enters Decoder 316 with associated Resistors 317 and 319 and Capacitors 318 and 320, if the received address matches that of the Low Order bits. The eight Data bits representing the alarm states of eight ARs outputted by Decoders 312 and 316 are ORed through OR gates 337, 336, and 335, applied through Buffer 332 and Resistor 331 to Transistor 331*a*. If a state of alarm is present, LED 329 is turned ON conducting current through Resistor 330 and Transistor 331A.

Referring back to Encoder 316, terminal 11 indicates whether the received address at terminal 9 is valid—HIGH output, (i.e. matches the address set by terminals A1–A5) or not valid—LOW output. Since the HIGH ORDER bits address and LOW ORDER bits address appear at terminal 9 of Decoder 316 alternately, the output at terminal 11 of Decoder 316 toggles between HIGH and LOW. This is used in conjunction with a "watch dog" function. The toggling signal is applied to ONE SHOT 321. The ON time duration is determined by Resistors 322 and Capacitor 323. The output from the ONE SHOT 321 resets Counter 325 and, if the toggled signal is present on a regular schedule (i.e. when there is no "TROUBLE"—such as a cut wire, for example), no output appears at terminal 12 of Counter 325. Counter 325 is pulsed by a clock composed of Inverters 355 and 357, Resistors 354 and 356 and Capacitor 358, through AND gate 339, provided AND gate is enabled by Inverter 338, which is the case as long as there is not "TROUBLE", i.e. the output at terminal 12 of Timer 325 is Low. When there is TROUBLE in the system causing a missing pulse at terminal 11 of Decoder 316, then the Counter 325 is not reset, and terminal 12 of Counter 325 goes HIGH. This turns ON LED 326 through Buffer 324, Resistors 340 and 327, and Transistor 327. It also turns ON LED 329 through NOR gate 334, Buffer 332, Resistors 331 and 330, and Transistor 331A, and it provides a signal also to transistor 333A through NOR gate 335, Buffer 334 and Resistor 333. The state of Trouble is also communicated to IO through Buffer 353, which puts the information on the DATA Bus. States of alarm are communicated to IO from Decoders 312 and 316 through Buffers 345–352.

The DR also transfers a "Reset" command from MC, via 10, to the SM. The reset pulse from MC is applied to terminal 25 of IO and from output 14 of IO it is applied to ONE SHOT 369 with associated Resistors 360 and 362 and Capacitors 361 and 363, which applies a negative going pulse to Encoder 359. The duration of the pulse is determined by Resistor 370 and Capacitor 371. The coded signal is transferred to the SM through Inverter 364 and Line Driver 366 with associated capacitor 365.

The DR is powered from a power supply in the IFCM through Voltage Regulator 343 with associated Capacitors 341 and 344.

Figure 6:
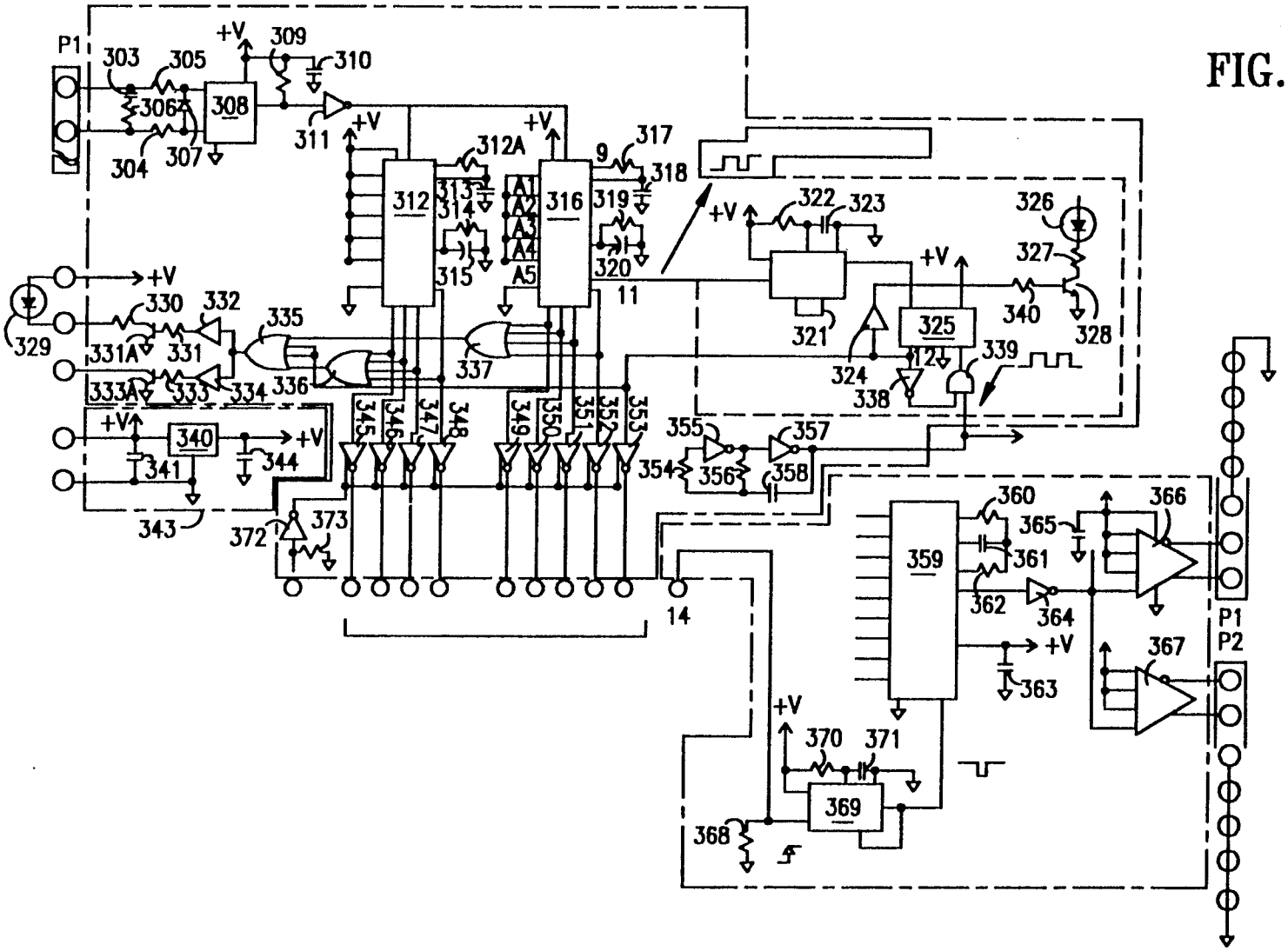
FIG. 6 is a logic diagram of the data receiver in accordance with the preferred embodiment of the invention.

Each DR card has circuitries for communication with two SMs. Only portions of the circuitry for Data processing and communication with a second SM is shown in FIG. 6.

Figure 7:
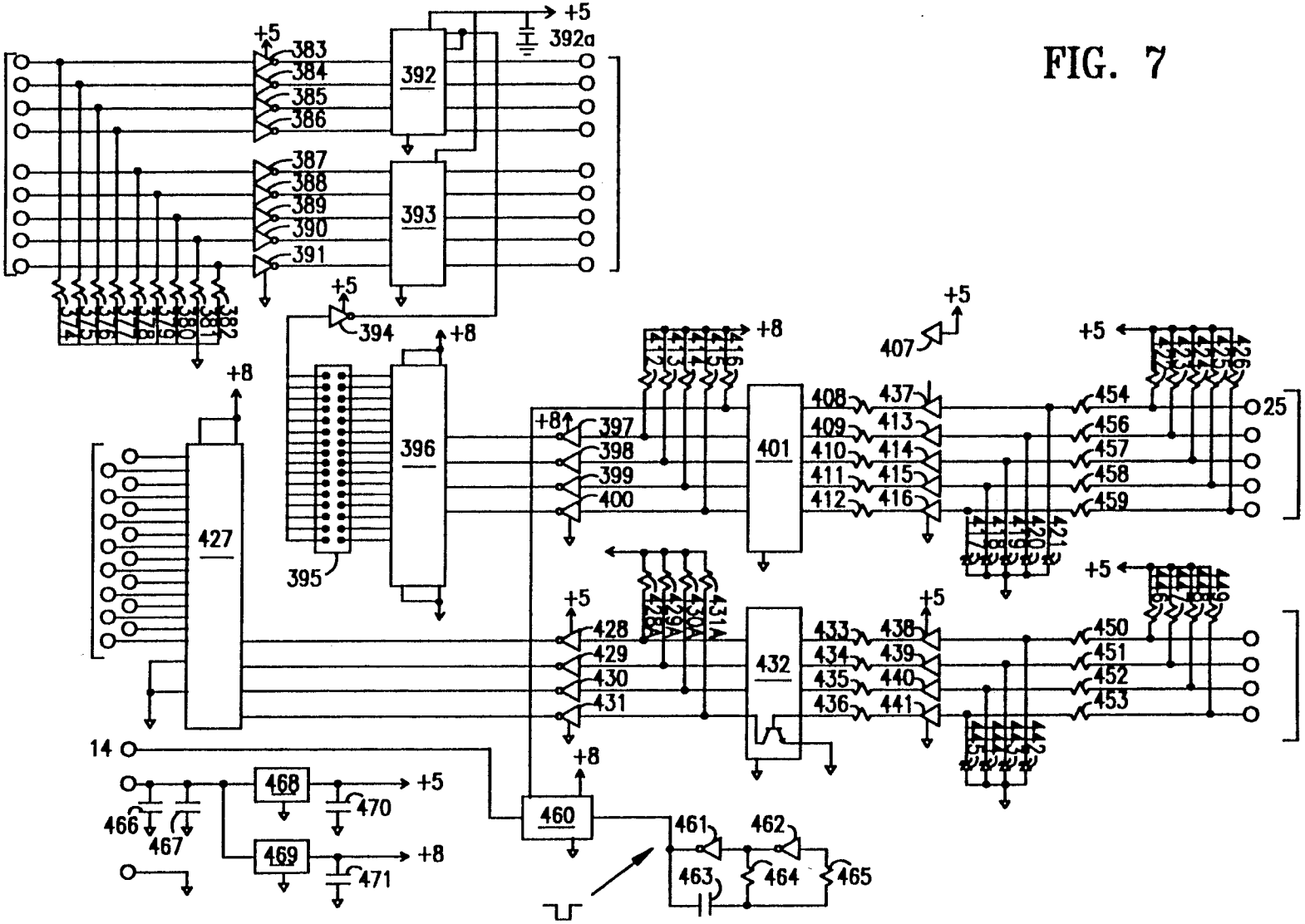
FIG. 7 is a logic diagram of the I/O interface card in accordance with the preferred embodiment of the invention.

6. I/O Interface Card (10)—FIG. 7—(inside IFCM)

The I/O Interface Card (IO) constitutes the interface between sixteen DRs (on eight cards) and the MC.

Eight bits from one DR, inside a particular IFCM, correspond to Alarm States from eight ARs and one bit corresponds to the Trouble State from one SM. The nine bit word is entered into Drivers 392 and 393 with associated Capacitor 392A through Inverters 381–391 with associated Resistors 374–382. This DATA is transferred to the MC when Drivers 392 and 393 are enabled through Inverter 394. The enable state is controlled by the four MSB (Most Significant Bits) of an eight-bit word originating in the MC which selects a particular IFCM. This Enable Select control is applied to Decoder 396 through Buffers 413–416 with associated Resistors 424–426; 417–421, and through four Transistors of Array 401 and Inverters 397–400. A particular IFCM of sixteen IFCMs is selected by Decoder 396 through a particular jumper of sixteen-jumper set 395. A particular SM of sixteen SMs connected to the IFCM is selected by Decoder 427. The Section Select is determined by four LSB (Least Significant Bits) of an eight-bit word originating in the MC. The Section Select information is transferred to Decoder 427 through Buffers 438–441 and associated Resistors 446, 453, 433–436 and amplitude limiting zener Diodes 442–445, and through Transistors of Array 432 and Inverters 428–431 and associated Resistors 438A–431A.

The IO also serves to transfer an Alarm Reset Command from the MC to the DRs from where a Reset Code is transmitted to the ARs through the SMs. The Reset Command Pulse from the MC is applied through terminal 25 to Buffer 437 with associated Resistors 408, 422 and 454 through a Transistor of Array 401 to Timer 460 which is being clocked by the oscillator composed of Inverters 461 and 462, Resistors 464 and 465 and Capacitor 463. The output of Timer 460 connects through terminal 14 to ONE-SHOT 369 of DR.

The IO is energized from a Power Supply in the IFCM through Voltage Regulators 468 and 469 with associated Capacitors 466, 467, 470 and 471.

Figure 8:
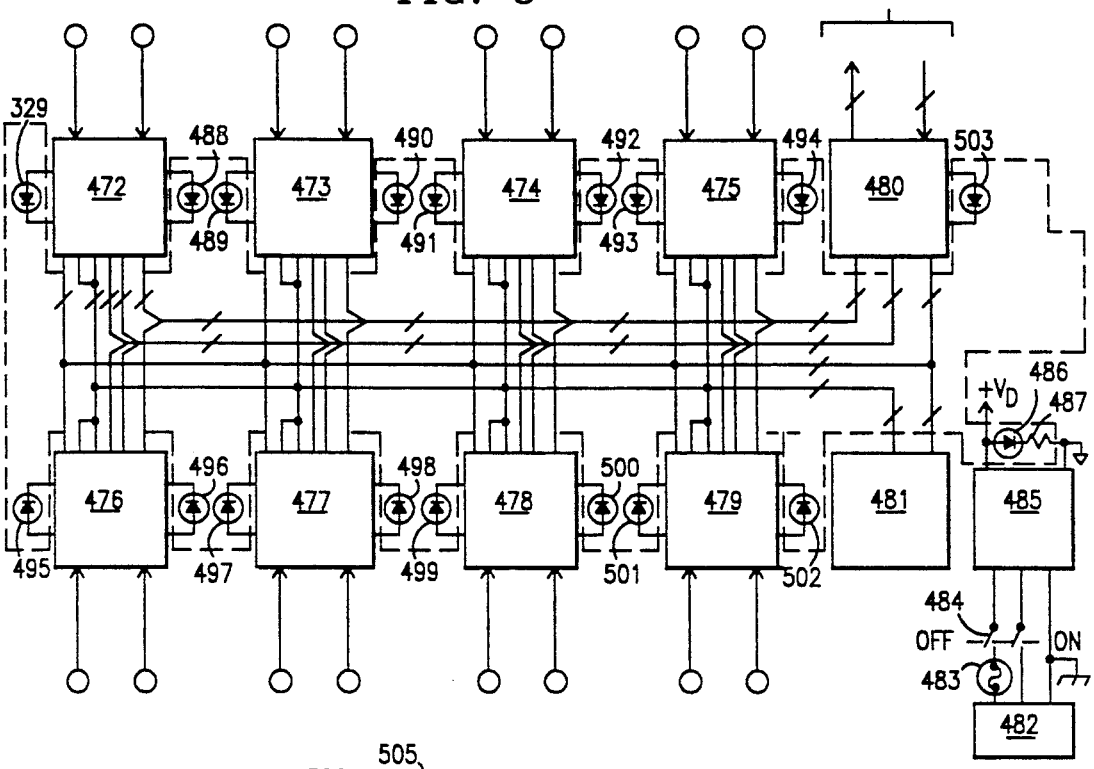
FIG. 8 is a logic diagram of the information flow control module in accordance with the preferred embodiment of the invention.

7. Information Flow Control Module (IFCM)—FIG. 8

The IFCM houses eight DRs 472–479, one IO 480, one Alarm Card 481 and Power Supply 485. The Alarm Card has an "Alarm Set" input and an "Alarm Reset" input. The power supply is connected to the Mains through a Line Filter 482, a Fuse 483 and a STDP (Single Throw Double Pole) Switch 484 and a Ground wire and LED 486 with associated Resistor 487. Each DR has two LEDs 329, and 488–502 to indicate a State of Alarm or Trouble (cut wire, for example), one LED each being associated with one SM.

The DRs are connected to a DATA BUS that also connects to IO and to the Alarm Card. Each DR receives an Alarm RESET and two ENABLE line inputs from the DATA BUS and outputs to the DATA BUS two Alarm lines and nine Alarm and Trouble State lines. The IO outputs Alarm Reset line to the DATA BUS and inputs from the DATA Lines sixteen Enable lines and 9 Alarm and Trouble State lines. The Alarm Card inputs from the DATA BUS one Alarm Set and one Alarm Reset line.

Figure 9:
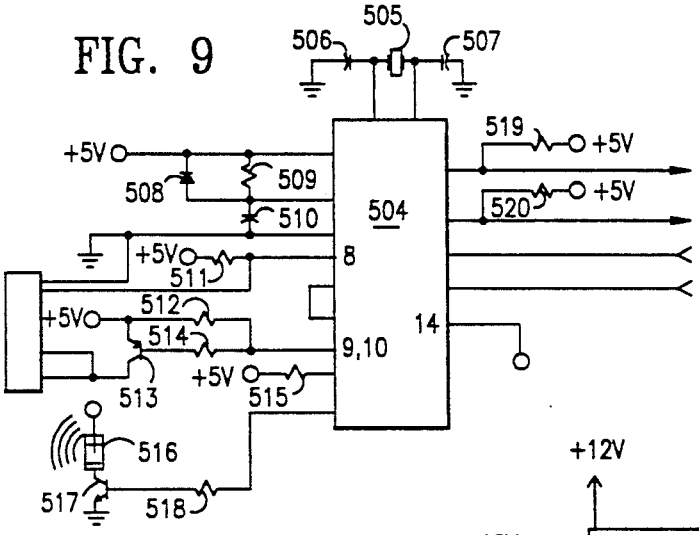
FIG. 9 is a logic diagram of the master code entry module in accordance with the preferred embodiment of the invention.

8. Haster Code Entry Module (MCEN)—FIG. 9

The MCEM reads and records into a Computer the identifying code of the HHAA. Each HHAA has an Infrared Bar Code attached to it. The MCEM consists of a Decoder 504 which contains a clock whose frequency is controlled by Crystal 505 with associated capacitors 506 and 507. A Scanner is connected to terminals 8, 9 and 10 of Decoder 504 through Transistor 513 with associated Resistors 512 and 514, and Resistor 511. Decoder 504 is energized through Diode 508, Resistor 509, Capacitor 510 and through Resistor 515 and terminal 14. The MCEM communicates with the computer via a serial I/O port in the computer with required voltages applied through Resistors 519 and 520.

9. Hand-Held Alarm Deactivator (HHAD)—FIG. 10

Figure 10:
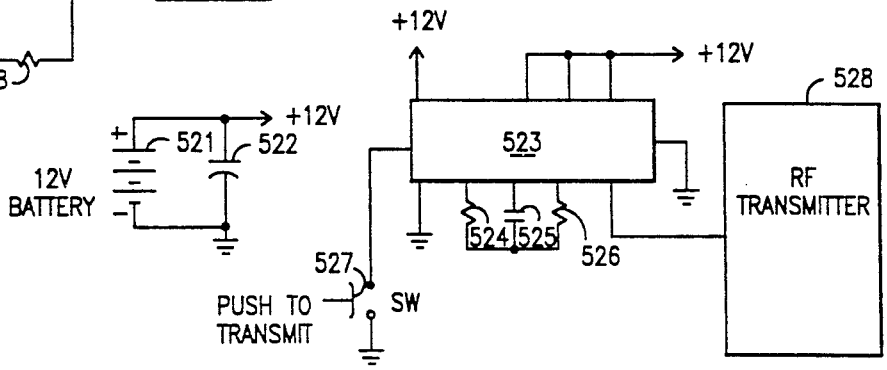
FIG. 10 is a logic diagram of the hand-held alarm deactivator in accordance with the preferred embodiment of the invention.

The circuit diagram of the HHAD is shown in FIG. 10. The HHAD contains an RF transmitter 529 of frequency of, for example, 320 Mhz.

The RF signal is modulated by means of Pulse Encoder 523 with associated Resistors 524 and 526 and Capacitor 525. (The code is different from the code used for the HHAA.) To transmit, switch 527 must be closed.

The HHAD is powered with Battery 521 shunted with Capacitor 522.

A computer program controls the scanning and video display. The floor plans and/or site layout where ARs are installed are stored in the computer. The program sets up the I/O ports for reading logic inputs from the IOs in the IFCMS. Before the first scan is executed all ARs are reset. The date and time from the calendar/-clock computer card in the computer are displayed on the video display screen and run continuously. A message such as "SCANNING", or a symbol, is displayed. The system scans all ARs. At the end of each scan cycle, "SCANNING", or the symbol, is removed and then displayed again before the next scanning cycle begins. This gives the effect of flashing and indicates that the system is scanning all ARs. The word "alarm" will be used also for "alarms" and "trouble" (i.e. interruption of operation as by a cut wire, for example). If an alarm indication is present at least twice for any three successive scans, it is interpreted as a valid alarm. If there is no alarm, the sequence as described above repeats and continues. If there is an alarm, and it is the first alarm detected, a floor plan or site layout of the area where the AR(s) has been activated (or interrupted) is drawn on the screen and the location of the activated AR(s) is indicated by superimposing a circle on the floor plan or site layout, and the area identification is also printed on the video screen. If another AR(s) is activated later, its location is also printed on the screen, and so on for other activated ARs, thus tracing the track of the activated ARs. When control R (AR) is pressed, or a signal is entered manually by turning a key, for example, the computer sends a Reset signal to all ARs, and the scanning continues.

Figure 11:
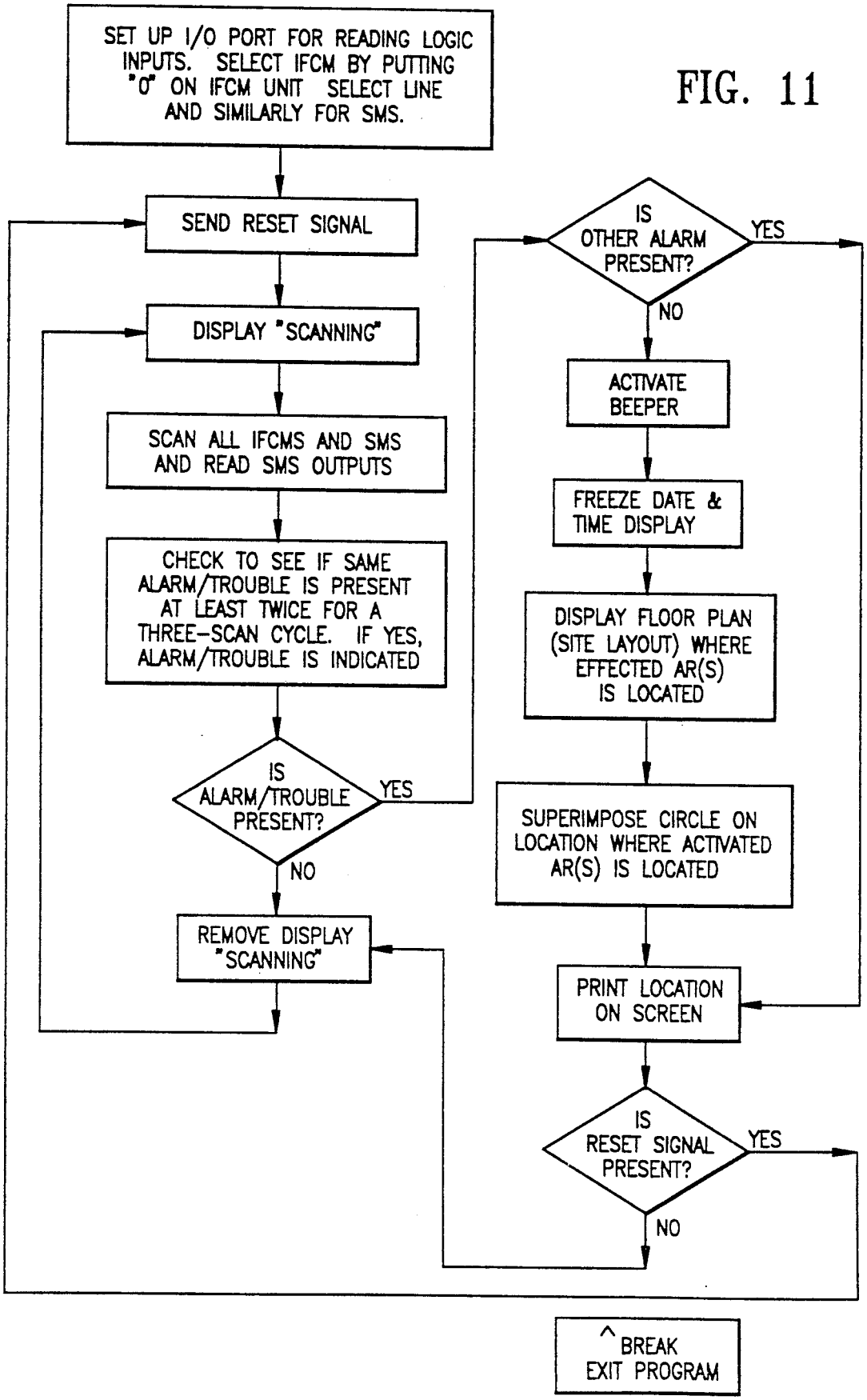
FIG. 11 is a computer program flow chart in accordance with the preferred embodiment of the invention.

Many variations are possible. For example, if ARs are activated simultaneously on more than one floor, the floor plans of both locations can be displayed on a split screen. One possible program is described by the Flow Chart in FIG. 11.

What is claimed is:

1. A personal security alarm system comprising:

a portable means for activating transmission of a first modulated radio-frequency signal having a predetermined frequency;

first and second pluralities of relay means, each relay means of said first and second pluralities of relay means stationed at a different location and outputting a signal having either of first and second binary values representing the state of the respective relay means, a signal having said first binary value being output in response to receipt of said first modulated radio-frequency signal having said predetermined frequency;

first and second section monitoring means respectively coupled to said first and second pluralities of relay means, the location of said first section monitoring means being different than the location of said second section monitoring means, said first section monitoring means serially outputting a first succession of signals corresponding to said signals from said first plurality of relay means and said second section monitoring means serially outputting a second succession of signals corresponding to said signals from said second plurality of relay means;

first and second data receiving means for respectively receiving and buffering said first and second successions of signals from said first and second section monitoring means, said first data receiving means outputting said signals of said first succession in parallel in response to a first enable signal and said second data receiving means outputting said signals of said second succession in parallel in response to a second enable signal;

first input/output interface means for outputting said first enable signal to said first data receiving means and then receiving said parallel signals of said first succession from said first data receiving means during a first time period, and outputting said second enable signal to said second data receiving means and then receiving said parallel signals of said second succession from said second data receiving means during a second time period different than said first time period, said first input/output interface means and said first and second data receiving means being parts of a first module; and master computing means for outputting first and second selection signals to said first input/output interface means at different times, wherein said master computing means receives said parallel signals of said first succession from said first input/output interface means in response to said first selection signal and receives said parallel signals of said second succession from said first input/output interface means in response to said second selection signal.

2. The personal security alarm system as defined in claim 1, wherein said first input/output interface means outputs said first enable signal in response to said first selection signal and outputs said second enable signal in response to said second selection signal.

3. The personal security alarm system as defined in claim 1, further comprising:

third and fourth pluralities of relay means, each relay means of said third and fourth pluralities of relay means outputting a signal having either of first and second binary values representing the state of the respective relay means, a signal having said first binary value being output in response to receipt of a radio-frequency signal having said first predetermined frequency;

third and fourth section monitoring means respectively coupled to said third and fourth pluralities of relay means, said third section monitoring means serially outputting a third succession of signals corresponding to said signals from said third plurality of relay means and said fourth section monitoring means serially outputting a fourth succession of signals corresponding to said signals from said fourth plurality of relay means;

third and fourth data receiving means for respectively receiving and buffering said third and fourth successions of signals from said third and fourth section monitoring means, said third data receiving means outputting said signals of said third succession in parallel in response to a third enable signal and said fourth data receiving means outputting said signals of said fourth succession in parallel in response to a fourth enable signal; and second input/output interface means for outputting said third enable signal to said third data receiving means and then receiving said parallel signals of said third succession from said third data receiving means during a third time period different than said first and second time periods, and outputting said fourth enable signal to said fourth data receiving means and then receiving said parallel signals of said fourth succession from said fourth data receiving means during a fourth time period different than said first, second and third time periods, said second input/output interface means and said third and fourth data receiving means being parts of a second module, wherein said master computing means outputs third and fourth selection signals to said second input/output interface means at different times, and receives said parallel signals of said third succession from said second input/output interface means in response to said third selection signal and receives said parallel signals of said fourth succession from said second input/output interface means in-response to said fourth selection signal.

4. The personal security alarm system as defined in claim 3, wherein said second input/output interface means outputs said third enable signal in response to said third selection signal and outputs said fourth enable signal in response to said fourth selection signal.

5. The personal security alarm system as defined in claim 4, wherein said selection signals comprise a first portion for selecting an input/output interface means and a second portion for selecting a section connected to said selected input/output interface means.

6. The personal security alarm system as defined in claim 1, wherein each relay means of said first and second pluralities comprises means for resetting the state of the respective relay means so that a signal having said second binary value is output thereby, said master computing means comprises means for outputting an alarm reset signal, said first input/output interface means comprises means for transmitting said alarm reset signal to said first and second data receiving means, said first and second data receiving means respectively comprise means for transmitting said alarm reset signal from said first input/output interface means to said first and second section monitoring means, and said first and second section monitoring means respectively comprise means for transmitting said alarm reset signal from said first and second data receiving means to said first and second pluralities of relay means, whereby each relay means of said first and second pluralities is reset in response to said alarm reset signal.

7. The personal security alarm system as defined in claim 1, further comprising a plurality of means for generating an audio alarm signal, each audio alarm signal generating means generating an audio alarm signal in response to receipt an alarm signal from a corresponding relay means located in proximity thereto, each relay means outputting said alarm signal in response to receipt of a radio frequency signal having said predetermined frequency.

8. The personal security alarm system as defined in claim 1, further comprising display means connected to said master computing means, said master computing means controlling said display means to display symbols identifying the location of a first relay means in response to said first relay means outputting a signal having said first binary value.

9. The personal security alarm system as defined in claim 1, wherein said portable means for activating transmission of a first modulated radio-frequency signal having a predetermined frequency comprises bar code identification means attached to a surface thereof.

10. The personal security alarm system as defined in claim 1, further comprising portable means for indicating the strength of said first modulated radio-frequency signal having said predetermined frequency being transmitted by said portable means for activating transmission of a first modulated radio-frequency signal having a predetermined frequency.

11. The personal security alarm system as defined in claim 1, further comprising first portable means for resetting said portable means for activating transmission of a first modulated radio-frequency signal having a predetermined frequency and second portable means for resetting an activated relay means.

12. The personal security alarm system as defined in claim 1, further comprising a scanner module for reading said bar code identification means on said portable means for activating transmission of a first modulated radio-frequency signal having a predetermined frequency and outputting signals identifying said portable means for activating transmission of a first modulated radio-frequency signal having a predetermined frequency to said master computing means.

13. The personal security alarm system as defined in claim 1, further comprising a portable means for activating transmission of a second modulated radio-frequency signal having said predetermined frequency, each relay means of said first and second pluralities outputting a signal having said second binary value in response to receipt of said second modulated radio-frequency signal having said predetermined frequency.

14. The personal security alarm system as defined in claim 1, wherein each of said relay means comprises transformer means for coupling said relay means to a power supply and back-up battery means for supplying power in the event of a failure of said power supply.

15. A personal security alarm system comprising:

a portable means for activating transmission of a first modulated radio-frequency signal having a predetermined frequency;

first and second pluralities of relay means, each relay means of said first and second pluralities of relay means being stationed at a different location and being activated to output an alarm signal in response to receipt of said first modulated radio-frequency signal having said predetermined frequency;

first and second section monitoring means respectively coupled to said first and second pluralities of relay means, said first section monitoring means outputting any alarm signal from said first plurality of relay means and said second section monitoring means outputting any alarm signal from said second plurality of relay means;

first and second data receiving means for respectively receiving and buffering any alarm signal from said first and second section monitoring means, said first data receiving means outputting a first multi-bit signal consisting of a multiplicity of bits in parallel, said first multi-bit signal identifying which one of said first plurality of relay means output an alarm signal in response to a first enable signal and said second data receiving means outputting a second multi-bit signal consisting of a multiplicity of bits in parallel, said second multi-bit signal identifying which one of said second plurality of relay means output an alarm signal in response to a second enable signal;

means for scanning said outputs of said first and second data receiving means;

mean for identifying an relay means activated by said portable means for activating transmission of a first modulated radio-frequency signal having a predetermined frequency; and display means connected to said identifying means, said scanning means controlling said display means to display symbols identifying the location of said activated relay means in response to said activated relay means outputting an alarm signal.

16. The personal security alarm system as defined in claim 15, wherein said scanning means comprises input/output interface means for outputting said first enable signal to said first data receiving means and then receiving said parallel multi-bit signal from said first data receiving means during a first time period, and outputting said second enable signal to said second data receiving means and then receiving said parallel multi-bit signals from said second data receiving means during a second time period different than said first time period, and said identifying means comprises master computing means for outputting first and second selection signals to said input/output interface means at different times, wherein said master computing means receives said parallel multi-bit signals from said input/output interface means in response to said first selection signal and receives said parallel multi-bit signals from said first input/output interface means in response to said second selection signal.

17. A portable device for resetting a portable alarm activator, said portable alarm activator comprising a transmitter for transmission of a first modulated radio-frequency signal having a predetermined frequency and means for activating said transmission of a first modulated radio-frequency signal having a predetermined frequency, comprising:

means for receiving said portable alarm activator;

means for determining whether said portable alarm activator has been activated, said determining means being effective only when said portable alarm activator is inserted in said receiving means in a predetermined direction; and means for deactivating said activated portable alarm activator when said portable alarm activator is inserted in said receiving means in a direction opposite to said predetermined direction.

18. The portable resetting device as defined in claim 17, wherein said determining means comprises a phototransistor and said deactivating means comprises magnetic coupling means.

* * * * *